US007682464B2

(12) United States Patent
Glenn et al.

(10) Patent No.: US 7,682,464 B2
(45) Date of Patent: Mar. 23, 2010

(54) AUTOMATED WASHING SYSTEM WITH COMPLIANCE VERIFICATION

(75) Inventors: James Glenn, Denver, CO (US); Paul R. Barnhill, Aurora, CO (US); Timothy Prodanovich, Boulder, CO (US)

(73) Assignee: Resurgent Health & Medical, LLC, Golden, CO (US)

( * ) Notice: Subject to any disclaimer, the term of this patent is extended or adjusted under 35 U.S.C. 154(b) by 109 days.

(21) Appl. No.: 11/617,177

(22) Filed: Dec. 28, 2006

(65) Prior Publication Data

US 2008/0099045 A1 May 1, 2008

Related U.S. Application Data

(60) Provisional application No. 60/863,753, filed on Oct. 31, 2006.

(51) Int. Cl.
*B08B 7/00* (2006.01)

(52) U.S. Cl. ..... 134/56 R; 134/57 R; 134/58 R; 340/573.1; 700/285; 702/176

(58) Field of Classification Search ..... 702/176; 134/56 R, 57 R, 58 R; 340/573.1; 700/285
See application file for complete search history.

(56) References Cited

U.S. PATENT DOCUMENTS

| | | | |
|---|---|---|---|
| 2,325,008 | A | 7/1943 | Gruett |
| 2,386,455 | A | 10/1945 | Green |
| 2,522,928 | A | 9/1950 | Carroll |
| 2,647,801 | A | 8/1953 | Lycan |
| 2,769,547 | A | 11/1956 | Hirsch |
| 2,826,763 | A | 3/1958 | Bass |
| 3,059,815 | A | 10/1962 | Parsons, Jr. |
| 3,081,471 | A | 3/1963 | Newell |
| 3,220,424 | A | 11/1965 | Nelson |
| 3,243,264 | A | 3/1966 | Hickey |
| 3,437,274 | A | 4/1969 | Apri |
| 3,529,774 | A | 9/1970 | Apri |
| 3,639,844 | A | 2/1972 | Karklys |
| 3,647,147 | A | 3/1972 | Cook |

(Continued)

FOREIGN PATENT DOCUMENTS

| | | |
|---|---|---|
| DE | 19903079 | 8/2000 |

(Continued)

OTHER PUBLICATIONS

International Search Report for International (PCT) Patent Application No. PCT/US2007/83221, mailed Aug. 6, 2008.

(Continued)

*Primary Examiner*—Alexander Markoff
(74) *Attorney, Agent, or Firm*—Sheridan Ross, P.C.

(57) ABSTRACT

A system is provided for providing automated washing and verifying compliance of use. The system provides for identifying individual users of one or more cleaning stations through various technologies, such as RFID. Individual's use of cleaning stations is monitored to determine compliance with hand-washing requirements. A compliance report may be generated based on data associated with one or more individuals' use of the cleaning station(s). Educational and/or entertainment content may be displayed to the user when he or she is using the cleaning station. Additionally, the cleaning station may identify containers having authorized consumables such as soap or disinfectant.

34 Claims, 7 Drawing Sheets

U.S. PATENT DOCUMENTS

| | | | | |
|---|---|---|---|---|
| 3,699,984 | A | 10/1972 | Davis | |
| 3,744,149 | A | 7/1973 | Helbling | |
| 3,754,559 | A | 8/1973 | Seiwert | |
| 3,757,806 | A | 9/1973 | Baaskar et al. | |
| 3,817,651 | A | 6/1974 | Law et al. | |
| 3,844,278 | A | 10/1974 | Weider | |
| 3,881,328 | A | 5/1975 | Kleimola et al. | |
| 3,918,117 | A | 11/1975 | Plante | |
| 3,918,987 | A | 11/1975 | Kopfer | |
| 3,967,478 | A | 7/1976 | Guinn | |
| 3,992,730 | A | 11/1976 | Davis | |
| 3,997,873 | A | 12/1976 | Thornton | |
| 4,001,599 | A | 1/1977 | Karklys | |
| 4,020,856 | A | 5/1977 | Masterson | |
| 4,073,301 | A | 2/1978 | Mackinnon | |
| 4,120,180 | A | 10/1978 | Jedora | |
| 4,137,929 | A | 2/1979 | Grossman | |
| 4,219,367 | A | 8/1980 | Cary, Jr. et al. | |
| 4,275,385 | A | 6/1981 | White | |
| 4,295,233 | A | 10/1981 | Hinkel et al. | |
| 4,398,310 | A | 8/1983 | Lienhard | |
| 4,402,331 | A | 9/1983 | Taldo et al. | |
| 4,453,286 | A | 6/1984 | Wieland | |
| 4,496,519 | A | 1/1985 | McGuire | |
| 4,509,543 | A | 4/1985 | Livingston et al. | |
| 4,601,064 | A | 7/1986 | Shipley | |
| 4,606,085 | A | 8/1986 | Davies | |
| 4,606,500 | A | 8/1986 | Mussler et al. | |
| 4,670,010 | A | 6/1987 | Dragone | |
| 4,688,585 | A | 8/1987 | Vetter | |
| 4,769,863 | A | 9/1988 | Tegg et al. | |
| 4,817,651 | A | 4/1989 | Crisp et al. | |
| 4,896,144 | A | 1/1990 | Bogstad | |
| 4,916,435 | A | 4/1990 | Fuller | |
| 4,921,211 | A | 5/1990 | Novak et al. | |
| 4,925,495 | A | 5/1990 | Crisp et al. | |
| 4,942,631 | A | 7/1990 | Rosa | |
| 4,999,613 | A | 3/1991 | Williamson et al. | |
| 5,016,172 | A | 5/1991 | Dessertine | |
| 5,031,258 | A | 7/1991 | Shaw | |
| 5,060,323 | A | 10/1991 | Shaw | |
| 5,074,322 | A | 12/1991 | Jaw | |
| RE33,810 | E | 2/1992 | Strieter | |
| 5,086,526 | A | 2/1992 | Van Marcke | |
| 5,119,104 | A | 6/1992 | Heller | |
| 5,184,642 | A | 2/1993 | Powell | |
| 5,193,563 | A | 3/1993 | Melech | |
| 5,199,118 | A | 4/1993 | Cole et al. | |
| 5,202,666 | A | 4/1993 | Knippscheer | |
| 5,238,749 | A | 8/1993 | Cueman et al. | |
| 5,257,423 | A | 11/1993 | Jacobsen et al. | |
| 5,265,628 | A | 11/1993 | Sage et al. | |
| 5,291,399 | A | 3/1994 | Chaco | |
| 5,340,581 | A | 8/1994 | Tseng et al. | |
| 5,387,993 | A | 2/1995 | Heller et al. | |
| RE35,035 | E | 9/1995 | Shipley | |
| 5,455,851 | A | 10/1995 | Chaco et al. | |
| 5,465,082 | A | 11/1995 | Chaco | |
| 5,503,840 | A | 4/1996 | Jacobson et al. | |
| 5,515,426 | A | 5/1996 | Yacenda et al. | |
| 5,548,637 | A | 8/1996 | Heller et al. | |
| 5,561,412 | A | 10/1996 | Novak et al. | |
| 5,572,195 | A | 11/1996 | Heller et al. | |
| 5,594,786 | A | 1/1997 | Chaco et al. | |
| 5,601,100 | A | 2/1997 | Kawakami et al. | |
| 5,610,589 | A | 3/1997 | Evans et al. | |
| 5,633,742 | A | 5/1997 | Shipley | |
| 5,670,945 | A | 9/1997 | Applonie | |
| 5,689,229 | A | 11/1997 | Chaco et al. | |
| 5,695,091 | A | 12/1997 | Winings et al. | |
| 5,699,038 | A | 12/1997 | Ulrich et al. | |
| 5,702,115 | A | 12/1997 | Pool | |
| 5,727,579 | A | 3/1998 | Chardack | |
| 5,745,272 | A | 4/1998 | Shipley | |
| 5,765,242 | A | 6/1998 | Marciano | |
| 5,774,865 | A | 6/1998 | Glynn | |
| 5,781,942 | A | 7/1998 | Allen et al. | |
| 5,793,653 | A * | 8/1998 | Segal | 702/176 |
| 5,808,553 | A | 9/1998 | Cunningham | |
| 5,812,059 | A | 9/1998 | Shaw et al. | |
| 5,818,617 | A | 10/1998 | Shipley | |
| 5,822,418 | A | 10/1998 | Yacenda et al. | |
| 5,822,544 | A | 10/1998 | Chaco et al. | |
| 5,823,447 | A | 10/1998 | Maybach | |
| 5,838,223 | A | 11/1998 | Gallant et al. | |
| 5,845,225 | A | 12/1998 | Mosher | |
| 5,860,437 | A | 1/1999 | Fernie | |
| 5,863,497 | A | 1/1999 | Dirksing | |
| 5,870,015 | A | 2/1999 | Hinkel | |
| 5,900,067 | A | 5/1999 | Jones | |
| 5,900,801 | A | 5/1999 | Heagle et al. | |
| 5,924,148 | A | 7/1999 | Flowers, Sr. | |
| 5,939,974 | A | 8/1999 | Heagle et al. | |
| 5,945,068 | A | 8/1999 | Ferone | |
| 5,945,910 | A * | 8/1999 | Gorra | 340/573.1 |
| 5,952,924 | A | 9/1999 | Evans et al. | |
| 5,954,069 | A | 9/1999 | Foster | |
| 5,966,573 | A | 10/1999 | Yu et al. | |
| 5,966,753 | A | 10/1999 | Gauthier et al. | |
| 5,972,126 | A | 10/1999 | Fernie | |
| 5,979,500 | A | 11/1999 | Jahrling et al. | |
| 5,992,430 | A | 11/1999 | Chardack et al. | |
| 6,029,600 | A | 2/2000 | Davis | |
| 6,031,461 | A | 2/2000 | Lynn | |
| 6,037,871 | A | 3/2000 | Babylon | |
| 6,038,331 | A | 3/2000 | Johnson | |
| 6,038,519 | A | 3/2000 | Gauthier et al. | |
| 6,110,292 | A | 8/2000 | Jewett et al. | |
| 6,125,482 | A | 10/2000 | Foster | |
| 6,131,587 | A | 10/2000 | Chardack et al. | |
| 6,147,607 | A | 11/2000 | Lynn | |
| 6,161,227 | A | 12/2000 | Bargenquast | |
| 6,176,941 | B1 | 1/2001 | Jewett et al. | |
| 6,195,588 | B1 | 2/2001 | Gauthier et al. | |
| 6,211,788 | B1 | 4/2001 | Lynn et al. | |
| 6,232,870 | B1 | 5/2001 | Garber et al. | |
| 6,235,351 | B1 | 5/2001 | DiMarzio et al. | |
| 6,236,317 | B1 | 5/2001 | Cohen et al. | |
| 6,236,953 | B1 | 5/2001 | Segal | |
| 6,268,797 | B1 | 7/2001 | Berube et al. | |
| 6,278,372 | B1 | 8/2001 | Velasco, Jr. et al. | |
| 6,317,717 | B1 | 11/2001 | Lindsey et al. | |
| 6,335,686 | B1 | 1/2002 | Goff et al. | |
| 6,344,794 | B1 | 2/2002 | Ulrich et al. | |
| 6,351,866 | B1 | 3/2002 | Bragulla | |
| 6,392,546 | B1 * | 5/2002 | Smith | 340/573.1 |
| 6,399,853 | B1 | 6/2002 | Roe et al. | |
| 6,404,837 | B1 | 6/2002 | Thompson et al. | |
| 6,413,921 | B1 | 7/2002 | Childers et al. | |
| 6,417,773 | B1 | 7/2002 | Vlahos et al. | |
| 6,424,262 | B2 | 7/2002 | Garber et al. | |
| 6,426,701 | B1 | 7/2002 | Levy et al. | |
| 6,431,189 | B1 | 8/2002 | Deibert | |
| 6,448,886 | B2 | 9/2002 | Garber et al. | |
| 6,462,656 | B2 | 10/2002 | Ulrich et al. | |
| 6,486,780 | B1 | 11/2002 | Garber et al. | |
| 6,523,193 | B2 | 2/2003 | Saraya | |
| 6,524,390 | B1 | 2/2003 | Jones | |
| 6,539,393 | B1 | 3/2003 | Kabala | |
| 6,542,568 | B1 | 4/2003 | Howes, Jr. et al. | |
| 6,577,240 | B2 | 6/2003 | Armstrong | |
| 6,600,420 | B2 | 7/2003 | Goff et al. | |
| 6,663,719 | B2 | 12/2003 | Shinozaki et al. | |
| 6,671,890 | B2 | 1/2004 | Nishioka | |

| | | | |
|---|---|---|---|
| 6,706,243 | B1 | 3/2004 | Sias et al. |
| 6,707,873 | B2 | 3/2004 | Thompson et al. |
| 6,727,818 | B1 | 4/2004 | Wildman et al. |
| 6,733,595 | B1 | 5/2004 | Grillo |
| 6,759,959 | B2 | 7/2004 | Wildman |
| 6,768,419 | B2 | 7/2004 | Garber et al. |
| 6,825,763 | B2 | 11/2004 | Ulrich et al. |
| 6,832,916 | B2 | 12/2004 | Collopy |
| 6,882,278 | B2 | 4/2005 | Winings et al. |
| 6,883,563 | B2 | 4/2005 | Smith |
| 6,892,143 | B2 | 5/2005 | Howes, Jr. et al. |
| 6,902,397 | B2 | 6/2005 | Farrell et al. |
| 6,938,282 | B2 | 9/2005 | Yamamoto |
| 6,956,498 | B1 | 10/2005 | Gauthier et al. |
| 6,970,574 | B1 | 11/2005 | Johnson |
| D512,648 | S | 12/2005 | Smith et al. |
| 6,975,231 | B2 | 12/2005 | Lane et al. |
| 6,992,561 | B2 | 1/2006 | Sandt et al. |
| 7,010,369 | B2 | 3/2006 | Borders et al. |
| 7,015,816 | B2 | 3/2006 | Wildman et al. |
| 7,020,508 | B2 | 3/2006 | Stivoric et al. |
| 7,023,980 | B2 | 4/2006 | Lenard et al. |
| 7,080,061 | B2 | 7/2006 | Kabala |
| 7,107,631 | B2 | 9/2006 | Lang et al. |
| 7,113,094 | B2 | 9/2006 | Garber et al. |
| 7,119,688 | B2 | 10/2006 | Wildman |
| 7,120,800 | B2 | 10/2006 | Ginter et al. |
| 7,123,151 | B2 | 10/2006 | Garber et al. |
| 7,150,293 | B2 | 12/2006 | Jonte |
| 7,174,577 | B2 | 2/2007 | Jost et al. |
| 7,242,306 | B2 | 7/2007 | Wildman et al. |
| 7,242,307 | B1 | 7/2007 | LeBlond et al. |
| 7,248,933 | B2 | 7/2007 | Wildman |
| 7,270,268 | B2 | 9/2007 | Garber et al. |
| 7,423,533 | B1 | 9/2008 | LeBlond et al. |
| 7,443,305 | B2 | 10/2008 | Verdiramo |
| 2002/0019709 | A1 | 2/2002 | Segal |
| 2002/0104083 | A1 | 8/2002 | Hendricks et al. |
| 2002/0135486 | A1 | 9/2002 | Brohagen et al. |
| 2002/0175182 | A1 | 11/2002 | Matthews |
| 2003/0069815 | A1 | 4/2003 | Eisenberg et al. |
| 2003/0089771 | A1 | 5/2003 | Cybulski et al. |
| 2003/0197122 | A1 | 10/2003 | Faiola et al. |
| 2004/0083547 | A1 | 5/2004 | Mercier |
| 2004/0133081 | A1 | 7/2004 | Teller et al. |
| 2004/0150527 | A1 | 8/2004 | Harper et al. |
| 2004/0255409 | A1 | 12/2004 | Hilscher et al. |
| 2005/0134465 | A1 | 6/2005 | Rice et al. |
| 2005/0136949 | A1 | 6/2005 | Barnes |
| 2005/0139239 | A1 | 6/2005 | Prae |
| 2005/0147526 | A1 | 7/2005 | Hishida |
| 2005/0151641 | A1 | 7/2005 | Ulrich et al. |
| 2005/0171634 | A1 | 8/2005 | York et al. |
| 2005/0248461 | A1 | 11/2005 | Lane et al. |
| 2006/0122474 | A1 | 6/2006 | Teller et al. |
| 2006/0132316 | A1 | 6/2006 | Wildman et al. |
| 2006/0214788 | A1 | 9/2006 | Ku et al. |
| 2006/0224051 | A1 | 10/2006 | Teller et al. |
| 2006/0229891 | A1 | 10/2006 | Grier |
| 2006/0231568 | A1 | 10/2006 | Lynn et al. |
| 2006/0241396 | A1 | 10/2006 | Fabian et al. |
| 2006/0264730 | A1 | 11/2006 | Stivoric et al. |
| 2007/0008146 | A1 | 1/2007 | Taylor et al. |
| 2007/0011893 | A1 | 1/2007 | Garber et al. |
| 2007/0020212 | A1 | 1/2007 | Bernalet et al. |
| 2007/0247316 | A1 | 10/2007 | Wildman et al. |
| 2007/0257803 | A1 | 11/2007 | Munro et al. |
| 2007/0273525 | A1 | 11/2007 | Garber et al. |
| 2008/0001763 | A1 | 1/2008 | Raja et al. |
| 2008/0031838 | A1* | 2/2008 | Bolling ..... 424/70.1 |

FOREIGN PATENT DOCUMENTS

| | | |
|---|---|---|
| EP | 0396039 | 11/1990 |
| EP | 0616658 | 9/1994 |
| EP | 0758702 | 2/1997 |
| EP | 1872802 | 1/2008 |
| EP | 1935515 | 6/2008 |
| FR | 2659217 | 9/1991 |
| GB | 2324397 | 10/1998 |
| JP | 5-329065 | 12/1993 |
| WO | WO 80/01983 | 10/1980 |
| WO | WO 93/10311 | 5/1993 |
| WO | WO 03/086274 | 10/2003 |

OTHER PUBLICATIONS

Written Opinion for International (PCT) Patent Application No. PCT/US2007/83221, mailed Aug. 6, 2008.
U.S. Appl. No. 11/617,024, filed Dec. 28, 2006, Prodanovich.
U.S. Appl. No. 11/689,582, filed Mar. 22, 2007, Barnhill.
U.S. Appl. No. 11/829,764, filed Jul. 27, 2007, Barnhill.
U.S. Appl. No. 11/829,769, filed Jul. 27, 2007, Barnhill.
U.S. Appl. No. 11/829,775, filed Jul. 27, 2007, Barnhill.
U.S. Appl. No. 11/829,781, filed Jul. 27, 2007, Barnhill.
U.S. Appl. No. 11/829,783, filed Jul. 27, 2007, Barnhill.
U.S. Appl. No. 11/852,099, filed Sep. 7, 2007, Glenn.
"Case Study: FL hospital used IT to monitor hand washing", FierceHealthIT website, dated Aug. 3, 2009, available at http://www.fiercehealthit.com/node/8503/print, printed on Aug. 11, 2009, p. 1.
"Michigan IT Companies Helping the University of Miami Center for Patient Safety Tackle a Leading Cause of Death Using an RTLS Solution to Monitor Staff Hand-Washing Compliance", prnewswire website, dated Jul. 29, 2009, available at http://news.prnewswire.com/DisplayReleaseContent.aspx?ACCT=104&STORY=/www/story/07-29-2009/0005068398&EDATE, printed on Aug. 10, 2009, pp. 1-2.
"Hygreen The Intelligent Hand Hygiene Solution", Xhale, Inc., date unknown, 2 pages.
"HyGreen: How it Works",available at http://www.xhale.com/hygreen/solution/How.asp,printed Jul. 14, 2009, pp. 1-2.
"HyGreen: Sample Reporting",available at http://www.xhale.com/hygreen/solution/Reporting.asp,printed Jul. 14, 2009, pp. 1-3.
International Preliminary Report on Patentability for International (PCT) Patent Application No. PCT/US2007/83221, mailed May 14, 2009.
"HandGiene" available at http://handgienecorp.com/index.jsp, printed Nov. 2, 2009, pp. 1-2.

* cited by examiner

CLEANING STATION-USE RECORD 336

| EMPLOYEE NAME (400) | TIME STAMP (404) | DURATION (408) | DATE (412) | COMPLIANCE (416) |
|---|---|---|---|---|
| Janet Smith | 08:00:00 a.m. | 10 secs | 5/21/2006 | Y |
| Bill Powers | 09:00:23 a.m. | 5 secs | 5/21/2006 | N |
| Jason Williams | 10:07:40 a.m. | 12 secs | 5/21/2006 | Y |
| Judy Jones | 11:10:05 a.m. | 11 secs | 5/21/2006 | Y |
| Sandra Collins | 11:20:31 a.m. | 6 secs | 5/21/2006 | N |

Fig. 4

EMPLOYEE RECORD 340

| EMPLOYEE NAME (500) | HAND WASHING STATISTICS (504) | CURRENT TRAINING SEGMENT (508) | PREFERRED ENTERTAINMENT CONTENT (512) | ALLERGY (516) |
|---|---|---|---|---|
| Sandra Collins | 94% | 3 | Sports | None |
| Bill Forbes | 97% | 5 | News | Solution A |
| Jane Givens | 91% | 4 | Sports | None |
| Judy Jones | 99% | 9 | News | None |
| Bill Powers | 85% | 1 | News | None |
| Janet Smith | 95% | 8 | Sports | None |
| Jason Williams | 90% | 4 | News | None |

Fig. 5

COMPLIANCE REPORT 640

| 700 EMPLOYEE NAME | 704 TIME | 708 DATE | 712 LOCATION | 716 FULL CYCLE |
|---|---|---|---|---|
| Janet Smith | 8:00 a.m. | 5/21/2006 | A | Y |
| Bill Powers | 9:00 a.m. | 5/21/2006 | A | N |
| Bill Forbes | 10:00 a.m. | 5/21/2006 | C | N |
| Jason Williams | 10:07 a.m. | 5/21/2006 | A | Y |
| Jane Givens | 10:30 a.m. | 5/21/2006 | D | N |
| Judy Jones | 11:10 a.m. | 5/21/2006 | A | Y |
| Sandra Collins | 11:20 a.m. | 5/21/2006 | A | Y |

Fig. 7

AUTOMATED WASHING SYSTEM WITH COMPLIANCE VERIFICATION

CROSS REFERENCE TO RELATED APPLICATION

The present application claims the benefit of U.S. Provisional Patent Application No. 60/863,753 filed on Oct. 31, 2006, and entitled "AUTOMATED WASHING SYSTEM WITH COMPLIANCE VERIFICATION", the entire content of which is incorporated herein by reference in its entirety.

FIELD

The present invention relates to automated washing systems, and more particularly, to automated washing systems comprising a way of monitoring and/or verifying user participation.

BACKGROUND

The importance of cleanliness has long been recognized, particularly in the fields of heath-care, food preparation, and laboratories, to name but a few. The practice of surgical scrubbing by surgeons and other operating room personnel is probably the epitome of efforts to cleanse the hands and forearms of persons working in sterile environments. Although manual hand-washing can appear effective, medical experts have concluded that automated hand-washing increases hand-washing compliance and reduces the risk of infection.

Touchless automated hand-washing devices are designed to wash the hands of the user and provide the proper amount of antimicrobial solution in a set time. Additionally, these systems diminish the deterrent effects of friction and irritation associated with frequent manual hand-washing. Notwithstanding the benefits and convenience of automated washing devices, difficulties still exist with verifying employee or staff use of the washing apparatus. Accordingly, it would be advantageous to have a system that provides automated washing with a way of verifying usage by the intended users.

In addition to the foregoing, problems also exist with verifying that the proper soap solutions or disinfectants are being used in a cleaning station. In addition, problems exist with assessing whether a user has an allergy where the user should not use a certain type of soap or disinfectant provided in a cleaning station. In addition, problems exist in providing a solution in a cleaning station to avoid an allergy of a user. Also, problems exist in providing user specific formulations that address, for example, the user's specific job duties. In addition, problems exist in motivating users to stay at a cleaning station for its entire cleaning cycle. Also, problems exist in providing information to a manager or administrator regarding monitoring one or more cleaning stations, wherein the monitoring may include review of data directed to addressing one or more of the above noted problems. These shortcomings are addressed by the various embodiments of the present invention.

SUMMARY

In accordance with embodiments of the present invention, a Radio Frequency Identification ("RFID") system is disclosed for use in connection with an automated hand-washing station. However, as described herein, other identifying technologies are appropriate, and such technologies are encompassed by the scope of the present invention. It is to be understood therefore, that RFID is used as an example and is not intended to limit the scope of the present invention.

The system is operable to record and report on user compliance with hand-washing requirements. To ensure user safety and product performance, the system has the capability to ensure that only authorized consumable solutions are used in the cleaning station. The RFID data capture capability, in conjunction with a video system, allows users to have real time feedback of their personal compliance as well as individual user focused information conveyed at the time of utilizing the cleaning station.

In accordance with one or more embodiments described herein, the user carries a RFID tag that is programmed with information specific to the individual. Upon approaching the cleaning station, a RFID reader recognizes the user's tag and records the user name, time, date, station location, and whether the cleaning event was a complete cycle. The data is stored in the readers' database until captured via various methods and transferred into a report format for the administrator. The administrator can then review the compliance statistics for the various users.

In a separate aspect of the invention, and in accordance with one or more embodiments described herein, the RFID system is well suited to monitoring whether a consumable item used in the cleaning station is authentic or not authorized. Upon detection of an improper consumables item the cleaning station may deactivate. A RFID tag is attached to the consumable product, such as a cleaning solution bottle. When installed in the cleaning station, the tag attached to the solution bottle will confirm to the RFID system by way of the unique tag identifier that the subject bottle contains an authorized solution. Without this verification, a user of the station may inadvertently use another solution that is harmful to the user or ineffective for the use intended. Another benefit is that an authorized solution will be at the correct viscosity to ensure the proper dosage is used in the wash cycle and the mechanical action of the station will not be compromised by plugged fluid nozzles and lines.

Various embodiments of the present invention are set forth in the attached figures and in the detailed description of the invention as provided herein and as embodied by the claims. It should be understood, however, that this Summary does not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

FIG. 4 is an exemplary station-use record in accordance with embodiments of the present invention;

FIG. 5 is an exemplary employee record in accordance with embodiments of the present invention;

FIG. 7 is an exemplary compliance report in accordance with embodiments of the present invention.

The drawings are not necessarily to scale.

DETAILED DESCRIPTION

The present invention is directed to a system and method for ensuring employee compliance with washing requirements, such as hand-washing requirements. However, it is to be understood that embodiments of the present application are also applicable to other types of washing systems, including for example, boot-washing systems. In accordance with embodiments of the present invention, employee use of one or more automated cleaning stations is monitored. The cleaning stations operate to dispense one or more fluids, such as water, a cleaning fluid, such as soap, and/or a disinfectant, etc., while a person's hands are placed in a washbasin. As used herein, a "washbasin" means a structure associated with the cleaning station where the hands (or boots) are cleaned, such as one or more wash cylinders, spray areas, pans, tubs, etc. Employees may be instructed to wash their hands for a minimum amount of time that has been determined to be sufficient to provide a complete cleaning. The minimum time needed to provide a complete cleaning and/or the types of fluids, agents, and/or cleaning methods used in the automated cleaning may vary depending a variety of factors including the employee's job duties and/or his or her past noncompliance. The cleaning stations are operable to record and report data related to employee compliance with such requirements.

Figure 1:
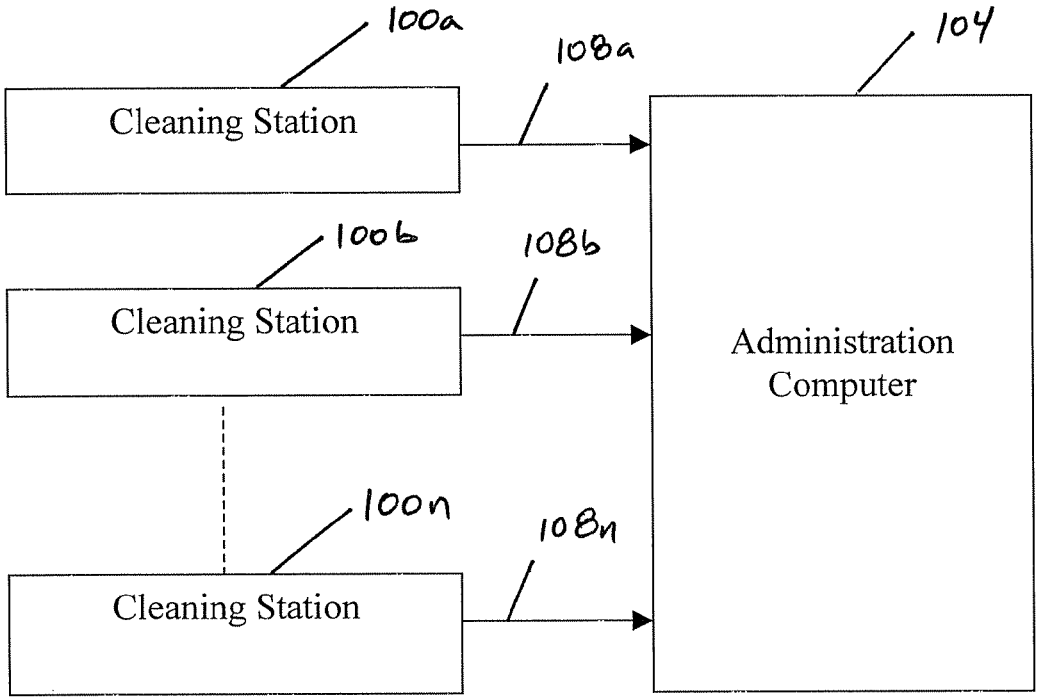
FIG. 1 is a block diagram of components that may be included in embodiments of the present invention.

Referring now to FIG. 1, components of a compliance system in accordance with embodiments of the present invention are illustrated in block diagram form. Shown in FIG. 1 is a plurality of cleaning stations 100*a*, 100*b* . . . 100*n*. The cleaning stations 100*a*-100*n* may be used by people employed at a facility that requires employees to wash their hands. Such facilities may include, for example, restaurants, food processing facilities, hospitals and laboratories. Also shown in FIG. 1 is an administration computer 104 for use by a manager or administrator of the facility. The administration computer 104 is operable to generate a compliance report as described herein.

The administration computer 104 communicates with the cleaning stations 100*a*-100*n* over a plurality of communication links 108*a*, 108*b* . . . 108*n*. The communication links may be implemented by any one of a variety of methods and may depend on the type of facility in which the cleaning stations 100*a*-100*n* are used. In particular, the communication links 108*a*-108*n* may be implemented as part of a local area network (LAN) or a wide area network (WAN). More particularly, the communication links 108*a*-108*n* may be implemented using such protocols as Ethernet or USB. The communications links 108*a*-108*n* may be implemented as wired or wireless connections. It may be the case that the administration computer 104 is located in a separate facility from one or more of the cleaning stations 100*a*-100*n*. In this case, a distributed data network such as the Internet may form part of the communication links 108*a*-108*n*.

Figure 2:
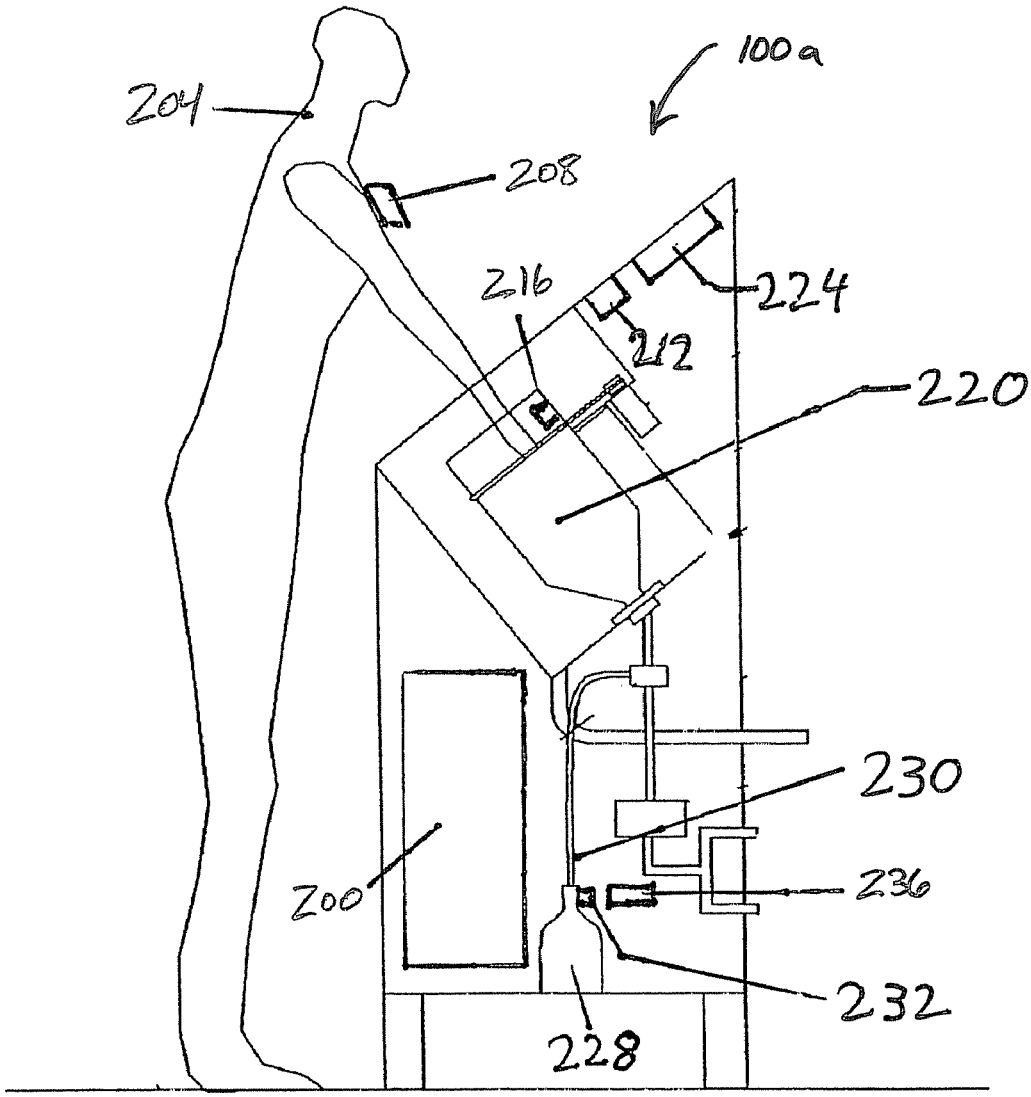
FIG. 2 is a schematic depiction of a cleaning station in accordance with embodiments of the present invention.

Referring now to FIG. 2, an exemplary cleaning station 100*a* is illustrated. The cleaning station 100*a* includes a cleaning station operations monitor 200. The cleaning station operations monitor 200 may comprise a computational device such as a general-purpose computer, controller, or ASIC that controls and coordinates the operation of the various electronic components associated with the cleaning station 100*a*. Additionally, the cleaning station operations monitor 200 is operable to record data associated with employee use of the cleaning station 100*a* and to report the data to the administration computer 104. The cleaning station operations monitor 200 may be incorporated into the cleaning station 100*a* or, alternatively, may be implemented as a separate computing device.

Also shown in FIG. 2 is a user 204 of the cleaning station 100*a*. The user 204 may be an employee or visitor who is required to wash their hands because of the nature of their work or the nature of the facility. The user 204 is shown wearing a user RFID tag 208. The user RFID tag 208 is programmed by an RFID tag programming device (not shown) with information such as an employee number that, when read, uniquely identifies the employee or user 204. The RFID tag 208 may be incorporated into an identification badge or bracelet worn by the user 204.

In accordance with embodiments of the present invention, the cleaning station 100*a* includes an RFID reader 212 and an optical sensor 216. The RFID reader 212 is positioned so as to be able to read the user RFID tag 208 when the user 204 is washing his or her hands at the cleaning station 100*a*. The RFID reader 212 may be incorporated into the cleaning station 100*a* or, alternatively, may be implemented as a stand-alone device. For example, the RFID reader 212 may be positioned adjacent to a cabinet associated with the cleaning station 100*a*. The optical sensor 216 is positioned so as to be able to sense that the hands of the user 204 are placed within the washbasin 220 in a position where they will properly receive cleaning fluids, such as water, soap and/or disinfectant as dispensed by the cleaning station 100*a*. The RFID reader 212 and the optical sensor 216 are in communication with cleaning station operations monitor 200, which, in turn, is operable to collect data associated with these devices. In particular, data is collected from the RFID reader 212 indicating the identity of the user 204. Additionally, the cleaning station operations monitor 200 records the length of time in which the hands of the user 204 were placed in the washbasin 220 as indicated by the optical sensor 216. In addition to RFID, other methods of identifying a user are within the scope of the present invention. In particular, a user may be identified by means of a typed password, retinal scan, voice print, palm print, fingerprint, face identification, bar coding (on an employee ID), etc.

The cleaning station 100*a* also includes a video display 224 positioned for viewing by the user 204 when he or she is washing his or her hands. The video display 224 may be incorporated in the cleaning station 100*a* or, alternatively, may be implemented as a separate device. For example, the video display 224 may be positioned on a wall in front of the user 204 as they stand at the cleaning station 100*a*. The video display 224 operates to display brief video segments to the user 204 while the cleaning station 100*a* is cleaning his or her hands. The video display 224 may be under the control of the cleaning station operations monitor 200. As the user 204 is utilizing the cleaning station 100*a*, administrator-selected data is transmitted to the video display 224. This information may be simple feedback to the user 204 informing them of the amount of hand washings they did in the current day, week, month, etc. In addition, there may be training programs that communicate information to the user 204, such as the risks of hand borne pathogens, to constantly remind the user 204 of the importance of hand hygiene. This system has the flexibility to provide a wide range of communications to the user 204.

Also shown in FIG. 2 is a consumables container 228 that contains a material, such as soap or disinfectant used in connection with the operation of the cleaning station 100*a*. Although not shown, a plurality of consumable containers 228 may be associated with a cleaning station 100*a*. The consumables container 228 includes a detachable connection to a consumable receptacle 230 associated with the cleaning station 100*a* so that the consumable container 228 may be removed and disposed of when its contents are expended. After the disposal of a used consumables container 228, a new consumables container 228 is then attached to the cleaning station 100*a*. In accordance with embodiments of the present invention, the consumables container 228 also includes a consumables RFID tag 232 that contains information related to the consumable container 228. A consumables RFID reader 236 associated with the cleaning station 100*a* reads the consumables RFID tag 232 and communicates information related to the consumables container 228 to the cleaning station operations monitor 200. Although RFID is discussed herein for use of identification of consumables, other types of identification systems may be used, such as bar codes.

Figure 3:
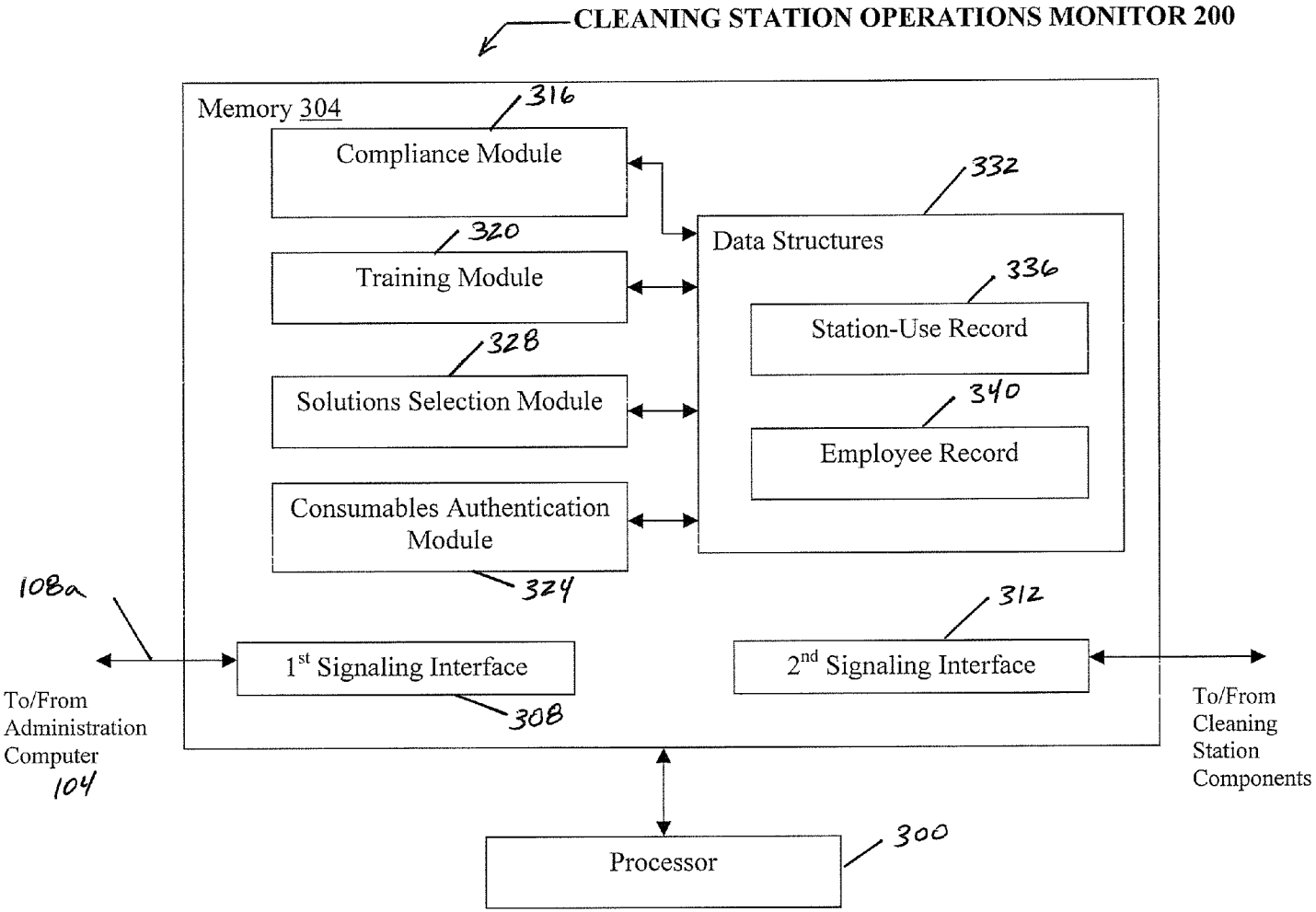
FIG. 3 is a block diagram of a cleaning station operations monitor in accordance with embodiments of the present invention.

Referring now to FIG. 3, a block diagram of components and features of the cleaning station operations monitor 200 is shown. As mentioned previously, the cleaning station monitor 200 is a computational device. Accordingly, the cleaning station operations monitor 200 includes a processor 300, a memory 304 and signaling interfaces 308 and 312 operable to communicate with external electronic and/or computational components. The first signaling interface 308 operates to communicate with the administration computer 104*a* over communication link 108*a*, as described above. The second signaling interface 312 operates to communicate with the various electronic components associated with the cleaning station 100*a* including the RFID readers 212 and 236, the optical sensor 216, and the video display 224. The second signaling interface 312 may be a portion of a backplane incorporated into cleaning station 100*a* that includes a connection to the cleaning station's 100*a* electronic components. Alternatively, if the cleaning station operations monitor 200 is implemented as a stand-alone computer, the cleaning station operations monitor 200 may communicate with the cleaning station's electronic components through a network or serial bus connection.

The memory 304 includes a plurality of stored program applications or modules that implement various features of a compliance monitoring system. In accordance with embodiments of the present invention, the memory 304 may include a compliance-monitoring module 316, a training module 320, a consumables authentication module 324, and/or a solutions selection module 328. Additionally, the memory 304 may include data structures 332 associated with the various modules. In accordance with embodiments of the present invention, the data structures 332 include a station-use record 336 and one or more employee records 340. The operation of the various modules and data structures is described in greater detail below.

The compliance-monitoring module 316 operates to monitor and record the activity of a plurality of users 204 of the cleaning station 100*a*. The process is outlined as follows. The user 204 approaches a cleaning station 100*a* with a RFID tag 208 on their person, which was programmed with a RFID tag programming device with the individual's name or number, and/or other pertinent data. The tag 208 is read by the RFID reader 212 when the user 204 approaches and/or begins using the cleaning station 100*a*. When the user 204 places his or her hands into the cleaning station washbasin 220, the optical sensor 216 initiates a cleaning cycle. If the hands of the user 204 do not stay in the washbasin 220 for the full cycle time, the optical sensor 216 will indicate in the data structure 332 that the user 204 did not have a complete cleaning. Once the user is finished using the cleaning station 100*a*, the data showing such items as user name, time, date, station location and/or identification, and whether the cycle was complete, etc., is stored in the data structure 332. The stored data is later accessed by the administration computer 104 in connection with the generation of a compliance report.

An exemplary station-use record 336 having data associated with a plurality of users 204 is shown in FIG. 4. In accordance with embodiments of the present invention, an entry in the station-use record 336 may include an employee name 400 indicating who used the cleaning station 100*a*, a time stamp 404 indicating when the cleaning cycle was initiated, a duration 408 indicating how long the user 204 kept his or her hands in the washbasin 220, the date 412, and a compliance indicator 416 specifying whether or not the user 204 kept his or her hands in the washbasin 220 for the required time. As an example, the station-use record shown in FIG. 4 indicates that on May 21, 2006 Janet Smith met the hand-washing requirement by completing a cleaning cycle that was initiated at 8:00.00 A.M. and that lasted for 10 seconds. In an alternative embodiment, the station-use record 336 may contain only raw data such as the time 404, date 412 and duration 408 of the cleaning cycle while determinations related to compliance requirements are made by a separate module running on the administration computer 104.

The compliance-monitoring module 316 may also operate to monitor hand-washing requirements that are specific to each employee. Some employees may have stricter hand washing requirements than others at the same facility. For example, a hospital emergency room may employ both surgeons and social workers. As can be appreciated, the surgeons will be required to wash their hands more frequently and more thoroughly than the social workers. Accordingly, the compliance-monitoring module 316 may access employee records to determine the type, concentration, and/or amount of cleaning fluid to be dispensed for a particular employee. Additionally, employee records may contain other hand washing compliance data that is specific to each employee such as the amount of time and/or frequency that an employee is required to wash his or her hands. Washing requirements may also depend on an employee's history of compliance with his or her washing requirements. For example, an employee may be required to wash his or her hands more thoroughly if his or her previous hand washings were incomplete.

Embodiments of the present invention may include a training module 320. In accordance with at least one embodiment of the present invention, the training module 320 operates to transmit educational information to the user 204 while the cleaning cycle is running via sound and/or a visual source, such as a video display 224. The information may comprise segments equal in duration, or slightly longer or shorter in duration than the cleaning cycle. For example, the segments may contain information regarding hand hygiene in a series of segments lasting approximately 10-15 seconds. In accordance with at least one embodiment of the present invention, the employee record 340 portion of the data structure 332 keeps track of the user 204 and knows the sequence of training segments so each time a user 204 uses the cleaning station 100*a*, the next pertinent training segment will display on the video display 224.

In accordance with at least one embodiment of the present invention, the training module 320 may access the employee record 340 to provide custom designed content in conjunction with the user's 204 needs/requests. Accordingly, as one possible alternative to educational/training content, entertainment content specific to the user's 204 preferences may be displayed. Here, other information is conveyed to the user, such as news (e.g., weather, breaking stories, current events, stock prices, etc.) and sports information. The training module 320 may, therefore, accommodate specific requests to convey information of interest to the user. In at least one embodiment of the present invention, the information conveyed to the user may be anything other than information about a cleaning station function parameter (e.g., water pressure, soap level, etc.). That is, content other than information about the cleaning station operating parameters so that the user is interested in staying at the cleaning station for an entire wash cycle.

The training module 320 may give feedback to the user 204 through the video display 224, including such information as their hand-washing statistics over a given period of time. For example the administrator of a facility may want to encourage system usage by conveying one or more compliance statistics, and/or informing a user 204 that the user 204 has won a prize by having high marks for compliance with the hand-washing protocol. Accordingly, the employee record 340 may keep track of data associated with user 204, and this data may be accessed by the training module 320 to inform the user 204 in real time, and/or the administrator in a subsequent report, as to compliance statistics.

The solutions selection module 328 may determine which solution is to be used with each individual user 204. For example, one user 204 may have an allergy to the standard solution, so the system is programmed to automatically use a different and appropriate solution when this user 204 is identified through their RFID tag 208. Information related to user allergies may be contained in the employee record 340.

An exemplary employee record 340 for use in connection with both the training module 320 and the solutions selection module 328 is shown in FIG. 5. In accordance with embodiments of the present invention, an entry in the employee record 340 may include the employee name 500, hand-washing 504 statistics associated with employee, current training segment 508 to be viewed by the employee, the employee's preferred entertainment content 512, and/or a listing of the employee's allergies 516. As an example, the employee record shown in FIG. 5 indicates that Bill Forbes is in 97% compliance with the hand-washing requirement, has currently viewed seven training modules, prefers to watch the news while washing his hands, and has an allergy to cleaning solution A.

In accordance with embodiments of the present invention, the employee record 340 may be an instance of a global employee record maintained centrally at the administration computer 104. Accordingly, the administration computer may periodically access and/or update a plurality of instances of employee records 340 associated with each cleaning station 100*a*-100*n* in order to maintain a comprehensive employee record. Alternatively, at least a portion of the employee use record 340 or data described herein as being associated with the employee use record 340 may be stored in the RFID tag 208 worn by the user 204. For example, a list of the user's 204 allergies may be stored in his or her RFID tag 208 and read by the RFID reader 212 when the user 204 washes his or her hands.

Embodiments of the present invention may include operation of a consumables authentication module 324 that operates to recognize when a non-authorized solution is introduced into the system. The consumables container 228 and/or a receptacle or fitting associated with the cleaning station 100*a* for receiving the consumables container 228 may be mechanically designed to discourage introducing non-authorized solutions to the system. In accordance with embodiments of the present invention, the consumables container 228 includes a consumable container RFID tag 232 that is recognized by the RFID reader 236 as an approved solutions container. If the consumables container 228 is withdrawn from the cleaning station 100*a* and reinstalled, the RFID reader 236 will recognize the tag as invalid and warn the user 204 through the video display 224 and/or the administrator through the administration computer 104 that this is not acceptable and potentially void the product warranty. Alternatively, or in addition thereto, an option is available where the cleaning station 100*a* will stop functioning at the direction of the consumables authentication module 328 until a proper consumables container 228 with a valid RFID tag 232 is inserted into the cleaning station solution receptacle 230. In yet another possible alternative and/or in addition to the options provided above, the known number of doses or applications of the consumable material may be associated with a valid RFID tag 232 and monitored by the consumables authentication module 328 so that once the number of applications is reached (and thus the consumable expended) the cleaning station 100*a* cannot be used until another valid consumables container 228 is installed. For example, say that one consumables container 228 contains enough cleaning fluid for approximately 500 hand-washing cycles. Once the cleaning station 100*a* has administered approximately 500 hand-washing cycles using a particular consumables container 228, then this container will no longer be operable with the cleaning station 100*a*. This prevents the consumable container 228 from being removed, refilled with a non-approved cleaning fluid, and then reattached for use with the cleaning station 100*a*. Such forced compliance for use of the proper consumables provides compliance regulators and/or administrators confidence that, for example, the approved disinfectants are being applied to the users 204 hands with each cleaning or use.

In addition to RFID, other methods and/or systems may be used to identify the consumables container 228. In particular, the consumable container 228 may be identified by a bar code and bar code reader.

Figure 6:
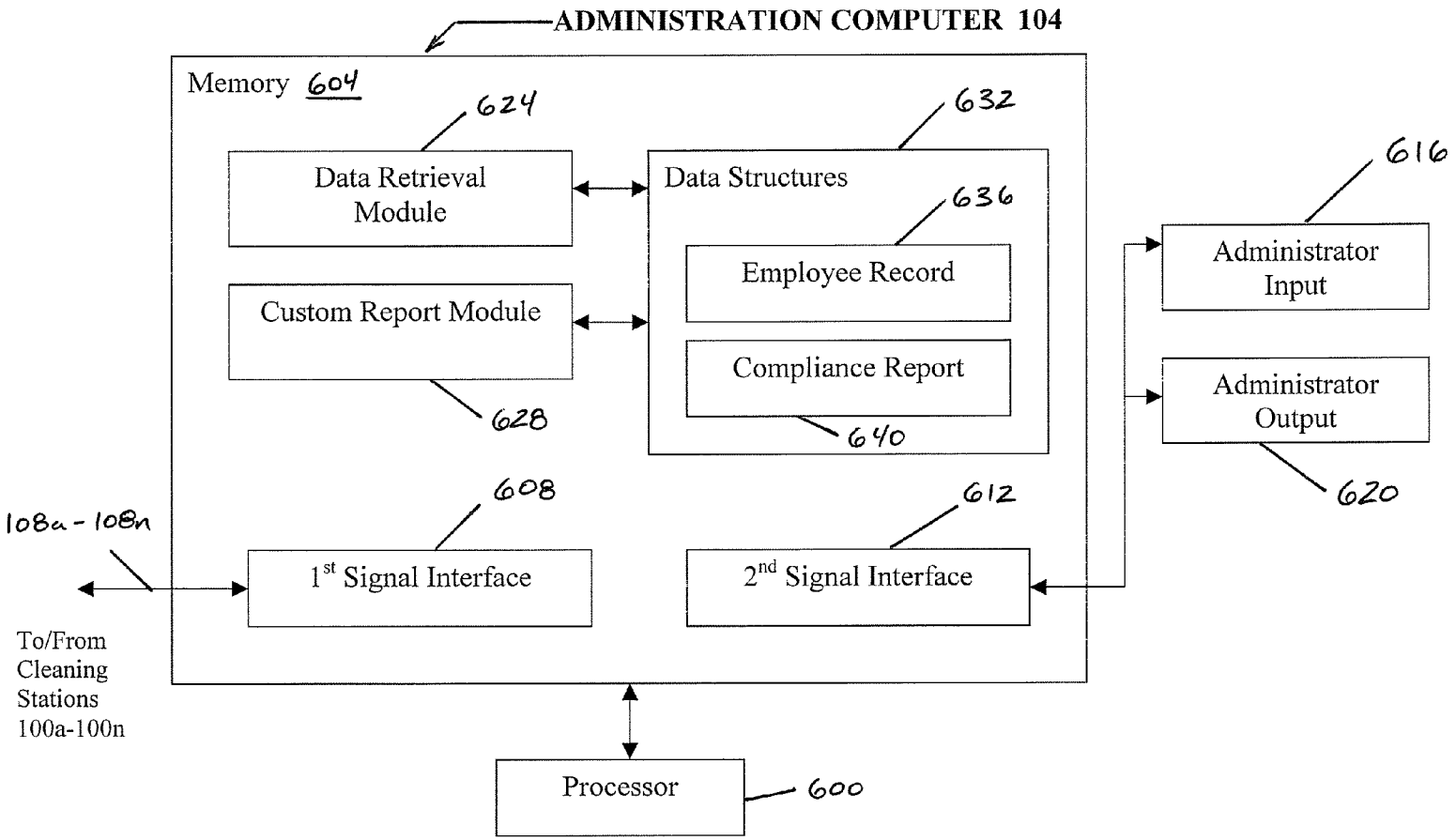
FIG. 6 is a block diagram of an administration computer in accordance with embodiments of the present invention.

Referring now to FIG. 6, a block diagram showing components and features of the administration computer 104 is illustrated. Administration computer 104 includes a processor 600, a memory 604 and signaling interfaces 608 and 612 operable to communicate with external electronic and/or computational components. The first signaling interface 608 operates to communicate with the cleaning stations 100*a*-100*n* over communication links 108*a*-108*n*, as described above. The second signaling interface operates to communicate with the various input 616 and output 620 devices associated with the administration computer 104. The input device 616 may be, for example, a keyboard or a mouse. The output device 620 may be, for example, a monitor or a printer.

The memory 604 includes a plurality of stored program applications or modules that implement various features of a compliance monitoring system. In accordance with embodiments of the present invention, the memory 604 may include a data retrieval module 624 and a custom report module 628. Additionally, the memory 604 may include data structures 632 associated with the various modules. In accordance with embodiments of the present invention, the data structures 632 may include an employee record 636 and/or a compliance report 640.

The data retrieval module 624 operates to retrieve data associated with cleaning stations 100*a*-100*n*. Such data may include data related to cleaning station usage and/or employee specific data. The data may be contained in a cleaning station-use record 336 and/or an employee record 340 associated with a cleaning station 100*a*-100*n*. Additionally, the data retrieval module 624 may operate to maintain a global employee record 636 as described above.

The custom report module 628 operates to generate the compliance report 640. The compliance report is generated from data contained in each station-use record 336 associated with cleaning stations 100*a*-100*n*. An exemplary compliance report is shown in FIG. 7. In accordance with embodiments of the present invention, an entry in the compliance report 640 may include an employee name 700, time stamp 704 indicating when a cleaning cycle was initiated, the date 708 of the cleaning cycle, the location 712 where the cleaning cycle took place, and a compliance indicator 716 specifying whether or not the user 204 met the compliance requirement. As an example, the compliance report shown in FIG. 7 indicates that on May 21, 2006 Janet Smith met the hand-washing requirement by completing a cleaning cycle that was initiated at 8:00.00 A.M at cleaning station A. As noted, compliance reports may include data pertaining to user statistics. Alternatively, or in addition to reports comprising user statistics, reports may be generated that are directed to the consumables, such as soap and disinfectants.

Figure 8:
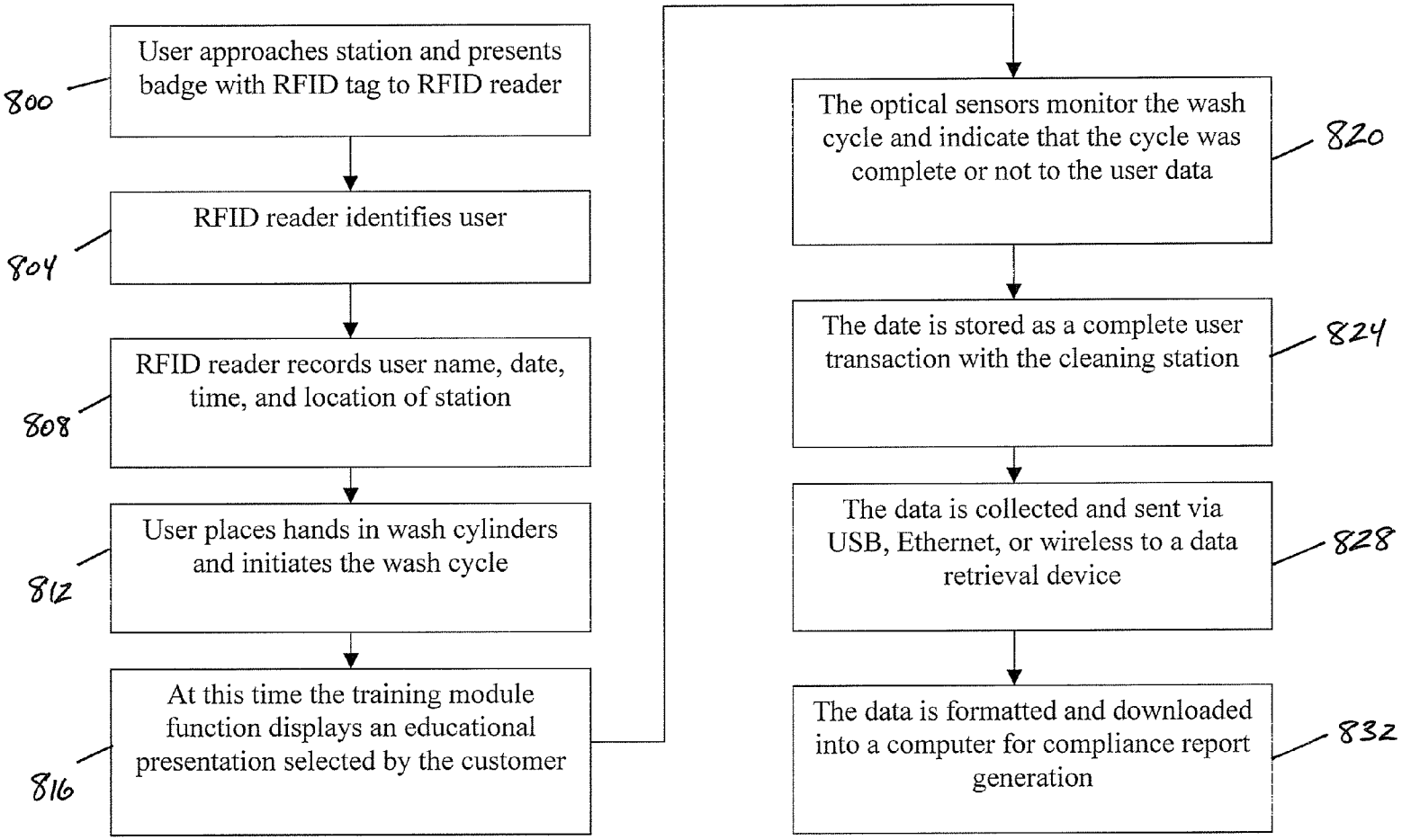
FIG. 8 is a flow chart depicting aspects of a method of monitoring hand-washing compliance in accordance with embodiments of the present invention.

In accordance with embodiments of the present invention, FIG. 8 shows a block diagram illustrating the steps of a method of monitoring a compliance requirement. Initially, at step 800 a user 204 approaches a cleaning station 100*a* and presents a badge having a RFID tag 208 to an RFID reader 212. At step 804 the RFID tag 208 is read and the user 204 is identified. At step 808 the user's 204 name, the date, the time, and the location of the cleaning station 100*a* are recorded. At step 812 a cleaning cycle is initiated when the user 204 places her or his hands in position to be washed. During the wash cycle, at optional step 816, the user 204 is provided with educational or entertainment content through the video display 224. At step 820 the wash cycle is completed and data is recorded including the duration of time the user 204 allowed his or her hands to be washed. At step 824 the transaction is completed and recorded. At step 828 data is collected from the cleaning stations 100*a*-100*n* over the communication links 108*a*-108*n*. Finally, at step 832 the collected data is used to generate a compliance report 640. Additional steps associated with the method may include: monitoring proper use of consumables; warning that an improper consumables container 228 has been installed; warning that a consumables container 228 is empty or nearly empty based on the number of uses since being installed; and warning that an one or more users are failing to meet compliance requirements.

The following U.S. patents are incorporated herein by reference in their entirety: U.S. Pat. Nos. 5,823,447; 5,265,628; 4,817,651; and 4,925,495.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A system, comprising:

(a) at least one cleaning station operable to wash at least a portion of a first user;

(b) an identification apparatus operatively associated with the cleaning station, the identification apparatus operable to identify at least one of:

(1) the first user, and (2) an object associated with the first user;

(c) a cleaning station operations monitor operatively associated with the cleaning station and the identification apparatus; and (d) a memory associated with the cleaning station operations monitor, the memory comprising:

(1) a compliance module operable to record data associated with the first user; and (2) a processor operable to select, based on a user identifier and/or job title of the first user, a specific cleaning regimen for the first user, wherein different user identifiers and/or job titles have different cleaning regimens and wherein a differing feature of the cleaning regimens is at least one of the following:

(i) a concentration of a cleaning substance;

(ii) a type of cleaning substance;

(iii) an amount of a cleaning substance;

(iv) a frequency of a cleaning function; and (v) a duration of a cleaning function.

2. The system as claimed in claim 1, further comprising an information module operable to provide the user with at least one segment of information about at least one of entertainment, a cleaning history statistic, and training, wherein the information module conveys information to the user by at least one of a video display and an audio speaker and wherein entertainment from the information module comprises at least one of news and sports.

3. The system as claimed in claim 1, further comprising a sensor disposed on or adjacent the cleaning station operable to provide a reading to determine if the portion of the user is in a position to be washed by the cleaning station, wherein the compliance module is in communication with the sensor; and an administration computer in communication with the cleaning station operations monitor, the administration computer being operable to generate a report based, at least in part, on data obtained or resulting from the identification apparatus.

4. The system as claimed in claim 1, wherein the identification apparatus reads other data from a user tag in addition to the user identity and wherein, for each use of the cleaning station, data associated with the use of the cleaning station includes one or more of: user identification; cleaning station designation; time of cleaning station use; duration of cleaning station use; date of cleaning station use; and a Boolean value indicative of user compliance with a washing requirement.

5. A system comprising:

at least a first cleaning station operable to wash at least a portion of a first user;

an identification apparatus operatively associated with the first cleaning station, the identification apparatus being operable to identify the first user; and a compliance monitoring module, executable by a computer, in communication with the identification apparatus, the compliance monitoring module being operable to record data associated with use of the first cleaning station by the first user, wherein the compliance monitoring module selects, based on a user identifier and/or job title of the first user, a specific set of cleaning requirements for the first user, wherein different user identifiers and/or job titles have differing sets of cleaning requirements and wherein a difference between the sets of cleaning requirements is at least one of the following:

(i) a different concentration of a cleaning substance;

(ii) a different type of cleaning substance;

(iii) a different amount of a cleaning substance;

(iv) a different frequency of a washing requirement; and (v) a different duration of a washing requirement.

6. The system as claimed in claim 5, further comprising an administration computer in communication with at least the cleaning station operations monitor, the administration computer being operable to generate a compliance report based on at least a portion of the data associated with use of the first cleaning station, wherein the administration computer is in communication with at least a second cleaning station operations monitor corresponding to a second cleaning station, the second cleaning station operatively associated with a corresponding second identification apparatus, the second cleaning station comprising a second compliance monitoring module in communication with the second identification apparatus, the second compliance monitoring module being operable to record data associated with use of the second cleaning station.

7. The system as claimed in claim 5, further comprising:

a sensor disposed on the first cleaning station operable to determine if the portion of the user is in a position to be washed by the first cleaning station, wherein the compliance monitoring module is in communication with the sensor; and a video display operatively associated with the cleaning station, the video display being operable to display video content to the user, wherein the memory further comprises a training module in communication with the video display, the training module being operable to provide the user with a series of training segments.

8. The system as claimed in claim 5, wherein the first cleaning station further comprises a consumables-authentication module operable to verify that the first cleaning station is operating with a particular substance.

9. The system as claimed in claim 5, wherein, for each use of the first cleaning station, data associated with the use of the first cleaning station includes one or more of: user identification; first cleaning station designation; time of first cleaning station use; duration of first cleaning station use; date of first cleaning station use; and a boolean value indicative of user compliance with a washing requirement.

10. The system as claimed in claim 1, wherein the differing feature is (i).

11. The system as claimed in claim 1, wherein the differing feature is (ii).

12. The system as claimed in claim 1, wherein the differing feature is (iii).

13. The system as claimed in claim 1, wherein the differing feature is (iv).

14. The system as claimed in claim 1, wherein the differing feature is (v).

15. The system as claimed in claim 1, wherein the user identifier and/or job title is user identifier.

16. The system as claimed in claim 1, wherein the user identifier and/or job title is job title.

17. The system as claimed in claim 1, wherein a first user having a first user identifier has a first wash compliance history, a second user having a second user identifier has a second wash compliance history, wherein the first and second wash compliance histories are different, and wherein, as a result of the difference between the first and second wash histories, the first and second users have differing first and second wash regimens, respectively.

18. The system as claimed in claim 5, wherein the differing feature is (i).

19. The system as claimed in claim 5, wherein the differing feature is (ii).

20. The system as claimed in claim 5, wherein the differing feature is (iii).

21. The system as claimed in claim 5, wherein the differing feature is (iv).

22. The system as claimed in claim 5, wherein the differing feature is (v).

23. The system as claimed in claim 5, wherein the user identifier and/or job title is user identifier.

24. The system as claimed in claim 5, wherein the user identifier and/or job title is job title.

25. The system as claimed in claim 5, wherein a first user having a first user identifier has a first wash compliance history, a second user having a second user identifier has a second wash compliance history, wherein the first and second wash compliance histories are different, and wherein, as a result of the difference between the first and second wash histories, the first and second users have differing first and second wash regimens, respectively.

26. A system, comprising:

(a) a cleaning device operable to wash at least a portion of a user;

(b) an identification apparatus operatively associated with the cleaning device, the identification apparatus being operable to identify the user; and (c) a computer, in communication with the identification apparatus, the computer being operable to record data associated with use of the cleaning device by the user, wherein the computer selects, based on a user identifier and/or job title of the user, a specific set of cleaning requirements for the user, wherein different user identifiers and/or job titles have differing sets of cleaning requirements and wherein a difference between the sets of cleaning requirements is at least one of the following:

(i) a different concentration of a cleaning substance;

(ii) a different type of cleaning substance;

(iii) a different amount of a cleaning substance;

(iv) a different frequency of a washing requirement; and (v) a different duration of a washing requirement.

27. The system as claimed in claim 26, wherein the differing feature is (i).

28. The system as claimed in claim 26, wherein the differing feature is (ii).

29. The system as claimed in claim 26, wherein the differing feature is (iii).

30. The system as claimed in claim 26, wherein the differing feature is (iv).

31. The system as claimed in claim 26, wherein the differing feature is (v).

32. The system as claimed in claim 26, wherein the user identifier and/or job title is user identifier.

33. The system as claimed in claim 26, wherein the user identifier and/or job title is job title.

34. The system as claimed in claim 26, wherein a first user having a first user identifier has a first wash compliance history, a second user having a second user identifier has a second wash compliance history, wherein the first and second wash compliance histories are different, and wherein, as a result of the difference between the first and second wash histories, the first and second users have differing first and second wash regimens, respectively.

* * * * *